US005955936A

United States Patent [19]

Shaw, Jr. et al.

[11] Patent Number: 5,955,936

[45] Date of Patent: Sep. 21, 1999

[54] PTC CIRCUIT PROTECTION DEVICE AND MANUFACTURING PROCESS FOR SAME

[75] Inventors: Philip C. Shaw, Jr., Elk Grove Village; Donna L. Randle, Chicago; Michael J. Weber, Arlington Heights; Michael J. Hoss, Des Plaines; Tom J. Hall, Arlington Heights, all of Ill.

[73] Assignee: Littlefuse, Inc., Des Plaines, Ill.

[21] Appl. No.: 08/859,624

[22] Filed: May 20, 1997

Related U.S. Application Data

[63] Continuation of application No. 08/437,966, May 10, 1995, abandoned.

[51] Int. Cl.[6] ..... H01C 7/10

[52] U.S. Cl. ..... 338/22 R; 338/328

[58] Field of Search ..... 338/22 R, 327, 338/328, 329, 330; 219/504

[56] References Cited

U.S. PATENT DOCUMENTS

| | | | |
|---|---|---|---|
| 3,243,753 | 3/1966 | Kohler | 338/31 |
| 3,351,882 | 11/1967 | Kohler et al. . | |
| 3,678,435 | 7/1972 | Pflanz | 338/263 |
| 3,828,332 | 8/1974 | Rekai | 340/227 R |
| 4,169,816 | 10/1979 | Tsien | 252/511 |
| 4,177,376 | 12/1979 | Horsma et al. | 219/553 |
| 4,177,446 | 12/1979 | Diaz | 338/212 |
| 4,223,209 | 9/1980 | Diaz | 219/549 |
| 4,237,441 | 12/1980 | van Konynenburg et al. | 338/22 |
| 4,238,812 | 12/1980 | Middleman et al. | 361/106 |
| 4,259,657 | 3/1981 | Ishikawa et al. | 338/22 R |
| 4,272,471 | 6/1981 | Walker | 264/104 |
| 4,314,230 | 2/1982 | Cardinal et al. | 338/314 |
| 4,314,231 | 2/1982 | Walty | 338/328 |
| 4,318,220 | 3/1982 | Diaz | 29/611 |
| 4,327,351 | 4/1982 | Walker | 338/22 R |
| 4,329,726 | 5/1982 | Middleman et al. | 361/58 |
| 4,330,703 | 5/1982 | Horsma et al. | 219/553 |
| 4,330,704 | 5/1982 | Jensen | 219/553 |
| 4,426,633 | 1/1984 | Taylor | 338/25 |

(List continued on next page.)

FOREIGN PATENT DOCUMENTS

| | | |
|---|---|---|
| 834993 | 2/1970 | Canada . |
| 1254323 | 5/1989 | Canada . |
| 0071119 A2 | 2/1983 | European Pat. Off. . |
| 0 169 058 A2 | 1/1986 | European Pat. Off. . |
| 0368206 A3 | 5/1990 | European Pat. Off. . |
| 0 588 136 A2 | 3/1994 | European Pat. Off. . |
| 1510940 | 12/1966 | France . |

(List continued on next page.)

OTHER PUBLICATIONS

Meyer, J., *Polymer Engineering and Science,* Glass Transition Temperature as a Guide to Selection of Polymers Suitable for PTC Materials, Nov., 1973, vol. 13, No. 6, pp. 462–468.

V. A. Ettel, P. Kalal, Inco Specialty Powder Products, Advances in Pasted Positive Electrode, (J. Roy Gordon Research laboratory, Mississauga, Ont.), Presented at NiCad 94, Geneva, Switzerland, Sep. 19–23, 1994.

(List continued on next page.)

*Primary Examiner*—Michael L. Gellner
*Assistant Examiner*—Karl Easthom
*Attorney, Agent, or Firm*—Wallenstein & Wagner, Ltd.

[57] ABSTRACT

Electrical devices having a PTC element of a polymer having conductive particles dispersed therein. The PTC element is coated with a conductive layer and has electrodes with a plurality of voids affixed to opposing surfaces. The devices are made by dispersing conductive particles into a polymer to form a polymer PTC composition. The polymer PTC composition is melt-shaped to form a laminar shaped PTC element. First and second opposing surfaces of the PTC element are coated with a conductive layer. The electrodes, characterized by a plurality of voids and made of foam, are brought into contact with the coated surfaces of the PTC element, and heated while applying pressure to form a laminate. The laminate is then further shaped into a plurality of PTC electrical circuit protection devices.

24 Claims, 3 Drawing Sheets

U.S. PATENT DOCUMENTS

| | | | |
|---|---|---|---|
| 4,445,026 | 4/1984 | Walker | 219/553 |
| 4,548,740 | 10/1985 | von Tomkewitsch et al. | 252/511 |
| 4,685,025 | 8/1987 | Carlomagno | 361/106 |
| 4,689,475 | 8/1987 | Kleiner et al. | 219/553 |
| 4,732,701 | 3/1988 | Nishii et al. | 252/511 |
| 4,749,623 | 6/1988 | Endo et al. | 428/551 |
| 4,800,253 | 1/1989 | Kleiner et al. | 219/553 |
| 4,801,785 | 1/1989 | Chan et al. | 219/549 |
| 4,833,305 | 5/1989 | Mashimo et al. | 219/549 |
| 4,876,439 | 10/1989 | Nagahori | 219/541 |
| 4,878,038 | 10/1989 | Tsai | 337/107 |
| 4,882,466 | 11/1989 | Friel | 219/219 |
| 4,959,632 | 9/1990 | Uchida | 338/22 |
| 4,966,729 | 10/1990 | Carmona et al. | 252/511 |
| 4,971,726 | 11/1990 | Maeno et al. | 252/511 |
| 4,973,934 | 11/1990 | Saito et al. | 338/22 R |
| 5,068,061 | 11/1991 | Knobel et al. | 252/511 |
| 5,089,801 | 2/1992 | Chan et al. | 338/22 R |
| 5,111,032 | 5/1992 | Batliwalla et al. . | |
| 5,136,365 | 8/1992 | Pennisi et al. | 357/72 |
| 5,142,263 | 8/1992 | Childers et al. | 338/21 |
| 5,143,649 | 9/1992 | Blackledge et al. | 252/511 |
| 5,174,924 | 12/1992 | Yamada et al. | 252/511 |
| 5,212,466 | 5/1993 | Yamada et al. | 338/22 R |
| 5,214,091 | 5/1993 | Tanaka et al. | 524/425 |
| 5,231,371 | 7/1993 | Kobayashi | 338/22 R |
| 5,247,276 | 9/1993 | Yamazaki | 338/22 R |
| 5,247,277 | 9/1993 | Fang et al. | 338/22 R |
| 5,250,228 | 10/1993 | Baigrie et al. | 252/511 |
| 5,257,003 | 10/1993 | Mahoney | 338/22 R |
| 5,268,665 | 12/1993 | Iwao | 338/22 R |
| 5,281,845 | 1/1994 | Wang et al. | 257/467 |
| 5,289,155 | 2/1994 | Okumura et al. | 338/22 SD |
| 5,313,184 | 5/1994 | Greuter et al. | 338/21 |
| 5,337,038 | 8/1994 | Taniguchi et al. | 338/22 R |
| 5,351,026 | 9/1994 | Kanbara et al. | 338/22 R |
| 5,358,793 | 10/1994 | Hanada et al. | 428/560 |
| 5,382,384 | 1/1995 | Baigrie et al. | 252/511 |
| 5,382,938 | 1/1995 | Hansson et al. | 338/22 R |
| 5,399,595 | 3/1995 | Gamble et al. | 252/511 |
| 5,518,840 | 5/1996 | Veerhoog et al. | 429/211 |

FOREIGN PATENT DOCUMENTS

| | | |
|---|---|---|
| 58-81264 | 5/1983 | Japan . |
| 58-81265 | 5/1983 | Japan . |
| 58-162877 | 10/1983 | Japan . |
| 58-162878 | 10/1983 | Japan . |
| 60-298148 | 12/1985 | Japan . |
| 62-79418 | 5/1987 | Japan . |
| 62-79419 | 5/1987 | Japan . |
| 63-85864 | 4/1988 | Japan . |
| 1-104334 | 4/1989 | Japan . |
| 2-109226 | 4/1990 | Japan . |
| 3-221613 | 9/1991 | Japan . |
| 3-271330 | 10/1991 | Japan . |
| 5-109502 | 4/1993 | Japan . |
| WO 93/14511 | 7/1993 | WIPO . |

OTHER PUBLICATIONS

Meyer, J., *Polymer Engineering and Science,* Stability of Polymer Composites as Positive–Temperature–Coefficient Resistors, Oct., 1974, vol. 14, No. 10, pp.706–716.

English Translation of Japanese Utility Model Application for Daito Electric dated Jan. 27, 1977, Article 29, item 1, Patent Law Article 30, Item 1, Overcurrent Protective Element.

PTC CIRCUIT PROTECTION DEVICE AND MANUFACTURING PROCESS FOR SAME

This is a continuation of application Ser. No. 08/437,966 filed on May 10, 1995 now abandoned.

DESCRIPTION

1. Technical Field

The present invention relates to polymer PTC electrical circuit protection devices and methods for producing them.

2. Background of the Invention

It is well known that the resistivity of many conductive materials change with temperature. Resistivity of a positive temperature coefficient (PTC) conductive material increases as the temperature of the material increases. Many crystalline polymers, made electrically conductive by dispersing conductive fillers therein, exhibit this PTC effect. These polymers generally include polyolefins such as polyethylene, polypropylene and ethylene/propylene copolymers. At temperatures below a certain value, i.e., the critical or trip temperature, the polymer exhibits a relatively low, constant resistivity. However, as the temperature of the polymer increases beyond this point, the resistivity of the polymer sharply increases. Devices exhibiting PTC behavior have been used as overcurrent protection in electrical circuits comprising a power source and additional electrical components in series. Under normal operating conditions in the electrical circuit, the resistance of the load and the PTC device is such that relatively little current flows through the PTC device. Thus, the temperature of the device (due to $I^2R$ heating) remains below the critical or trip temperature. If the load is short circuited or the circuit experiences a power surge, the current flowing through the PTC device increases and its temperature (due to $I^2R$ heating) rises rapidly to its critical temperature. As a result, the resistance of the PTC device greatly increases. At this point, a great deal of power is dissipated in the PTC device. This power dissipation only occurs for a short period of time (fraction of a second), however, because the power dissipation will raise the temperature of the PTC device to a value where the resistance of the PTC device has become so high, that the original current is limited to a negligible value. This new current value is enough to maintain the PTC device at a new, high temperature/high resistance equilibrium point. This negligible or trickle through current value will not damage the electrical components which are connected in series with the PTC device. Thus, the PTC device acts as a form of a fuse, reducing the current flow through the short circuit load to a safe, low value when the PTC device is heated to the critical temperature range. Upon interrupting the current in the circuit, or removing the condition responsible for the short circuit (or power surge), the PTC device will cool down below its critical temperature to its normal operating, low resistance state. The effect is a resettable, electrical circuit protection device.

Polymer PTC electrical circuit protection devices are well known in the industry. Conventional polymer PTC electrical devices include a PTC element interposed between a pair of electrodes. The electrodes can be connected to a source of power, thus, causing electrical current to flow through the PTC element. The PTC element generally comprises a particulate conductive filler which is dispersed in an organic polymer. Materials previously used for electrodes include wire mesh or screen, solid and stranded wires, smooth and micro-rough metal foils, perforated metal sheets, expanded metal, and porous metals.

For example, U.S. Pat. No. 3,351,882 (Kohler et al.) discloses a resistive element composed of a polymer having conductive particles dispersed therein and electrodes of meshed construction embedded in the polymer. The mesh constructed electrodes disclosed in Kohler et al. are in the form of spaced-apart small wires, wire mesh or wire screening, and a perforated sheet of metal. Generally, electrodes of this type result in a PTC device with a high initial resistance even when the resistivity of the conductive polymer is low. In addition, the use of mesh electrodes with polymer PTC devices are susceptible to the formation of electrical stress concentrations, i.e., hot-spots, which can lead to subpar electrical performance, or even failure of the device. Moreover, conductive terminals which in turn are connected to a power source causing current to flow through the device are difficult to connect to mesh electrodes such as those disclosed in Kohler et al.

Japanese Kokai No. 5-109502 discloses an electrical circuit protection device comprising a polymer PTC element and electrodes of a porous metal material. However, electrodes of this type also present difficulties when connecting conductive terminals to the porous electrodes, resulting in initially high resistant devices.

SUMMARY OF THE INVENTION

Accordingly, it is an object of the present invention to provide an electrical device with improved physical contact between the electrode and the PTC element without sacrificing the electrical performance of the device.

It is also an object of the present invention to provide an electrical device which can be connected to conductive terminals without producing an electrical device with an initially high electrical resistance.

In one aspect the present invention provides an electrical device comprising a PTC element including a polymer with electrically conductive particles dispersed therein. The PTC element has first and second opposed surfaces with a conductive layer contacting the first and second opposed surfaces of the PTC element. A pair of electrodes, each said electrode having an inner surface and an outer surface with a plurality of voids, are affixed to the opposing surfaces of the PTC element. The outer surface of each electrode can be connected to a source of electrical power, causing current to flow through the PTC element.

In a second aspect the present invention provides an electrical device comprising a PTC element composed of a polymer having electrically conductive particles dispersed therein. The PTC element has first and second opposed surfaces with a conductive layer contacting the first and second opposed surfaces of the PTC element. A pair of electrodes, each said electrode having a three-dimensional, initially open cellular structure characterized by an inner boundary and an outer boundary, are affixed to the first and second opposed surfaces of the PTC element. The outer boundary of each said electrode can be connected to a source of electrical power, causing current to flow through said PTC element.

In a third aspect the present invention provides a method of making an electrical device comprising providing a laminar shaped PTC element having first and second surfaces. The PTC element includes a polymer with conductive particles dispersed therein. The first and second surfaces of the PTC element are coated with a conductive layer. The first coated surface of the laminar shaped PTC element is brought into contact with a first electrode, said electrode having an inner surface and an outer surface with a plurality of voids.

The second coated surface of the laminar shaped PTC element is brought into contact with a second electrode, said electrode having an inner surface and an outer surface with a plurality of voids. Heat and pressure are applied to the coated PTC element and the electrodes to form a laminate. The laminate is then further formed into a plurality of PTC electrical devices.

In yet another aspect the present invention provides a method of making an electrical device comprising providing a laminar shaped PTC element having first and second surfaces. The PTC element includes a polymer with conductive particles dispersed therein. The first and second surfaces of the PTC element are coated with a conductive layer. The first coated surface of the laminar shaped PTC element is brought into contact with a first electrode and the second coated surface of the laminar shaped PTC element is brought into contact with a second electrode. The electrodes have a three-dimensional, initially open cellular structure characterized by an inner boundary and an outer boundary. Heat and pressure are applied to the coated PTC element and the electrodes to form a laminate. The laminate is then further formed into a plurality of PTC electrical devices.

Other advantages and aspects of the present invention will become apparent upon reading the following description of the drawings and detailed description of the invention.

DETAILED DESCRIPTION

Figure 1:
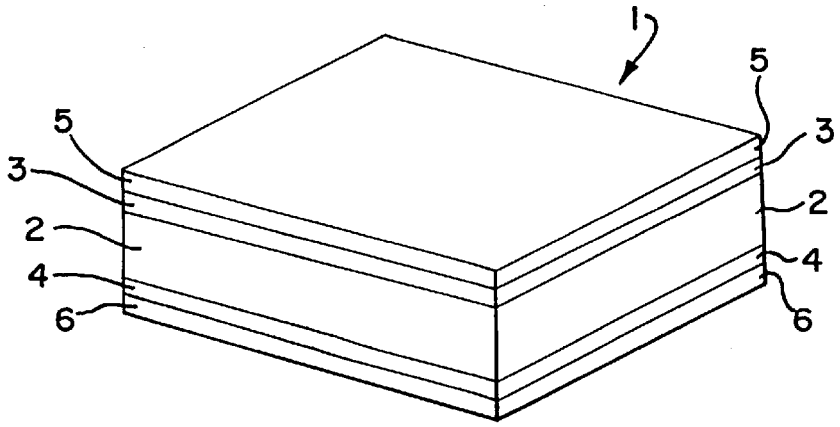
FIG. 1 is a perspective view of an electrical circuit protection device according to the present invention.

While this invention is susceptible of embodiment in many different forms, there is shown in the drawings and will herein be described in detail preferred embodiments and methods of manufacture with the understanding that the present disclosure is to be considered as an exemplification of the principles of the invention and is not intended to limit the broad aspect of the invention to the embodiments illustrated.

FIG. 1 illustrates an electrical circuit protection device 1 according to the present invention. The device 1 comprises a PTC element 2, conductive layers 3 and 4, and electrodes 5 and 6.

Electrodes 5 and 6 include a plurality of voids in a metal material selected from the group consisting of nickel, copper, zinc, silver, and gold. Specifically, electrodes 5 and 6 can be wire mesh, screen mesh, wire cloth, perforated sheet metal, or expanded metal.

Figure 2:
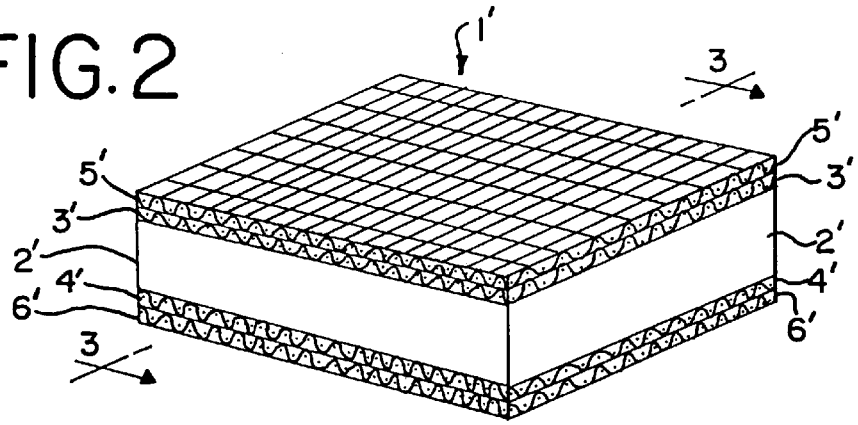
FIG. 2 is a perspective view of an electrical circuit protection device according to a first embodiment of the present invention.
Figure 3:
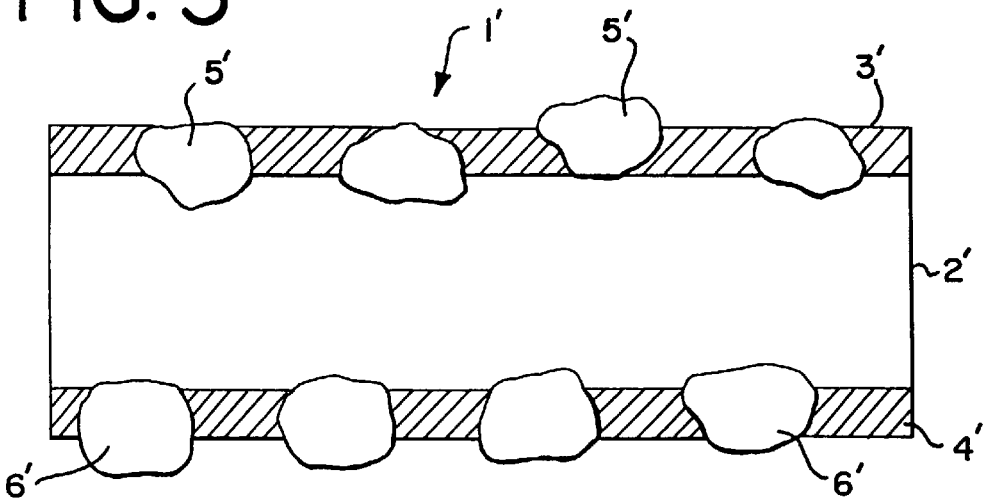
FIG. 3 is a cross-sectional view of the electrical circuit protection device in FIG. 2.

FIGS. 2 and 3 illustrate a preferred embodiment of the present invention in which electrodes 5' and 6' are wire cloth (distributed by McMaster-Carr, No. 9224T39) having 100× 100 mesh per linear inch, a wire diameter of 0.0045 inch, and a width opening of 0.006 inch. Electrodes 5' and 6' are generally less than 0.01 inch thick, however, it is preferred that electrodes 5' and 6' are 0.003 to 0.008 inch thick.

PTC element 2' includes a conductive polymer exhibiting PTC behavior. The polymer is made conductive by dispersing conductive particles therein. Preferably the polymer is a polyolefin. Examples of polymers which can be used in the present invention include polyethylene, polypropylene, polybutadiene, polyethylene acrylates, ethylene acrylic acid copolymers, and ethylene propylene copolymers. In a preferred embodiment, the polymer is a high density polyethylene such as Petrothene LB 8520-00, manufactured by Quantum. The electrically conductive particles dispersed in the polymer comprise a conductive material selected from the group consisting of pure metal particles, metal alloy particles, and carbonaceous particles. Examples of electrically conductive particles which can be used in the present invention include materials such as nickel powder, silver powder, gold powder, copper powder, silver-plated copper powder, powders of metal alloys, carbon black, carbon powder, and graphite. In a preferred embodiment, the electrically conductive particles comprise carbon black, preferably one that has a ASTM classification N660, such as Raven 430, manufactured by Columbian Chemical Co.

In another embodiment of the present invention, PTC element 2' includes a non-conductive particulate filler which increases the stability of the composition at higher temperatures. Examples of non-conductive particulate fillers to be used in the present invention include fumed silica and ceramic microspheres.

Generally, PTC element 2' is less than 0.03 inch thick, preferably less than 0.02 inch thick and has an electrical resistivity at 25° C. of generally less than 5 ohm cm, preferably less than 1 ohm cm, and more preferably less than 0.8 ohm cm.

Conductive layers 3' and 4' are applied to first and second opposed surfaces of PTC element 2'. Conductive layers 3' and 4' can comprise a conductive polymer such as a conductive thermoset resin, a conductive thermoplastic, or a conductive thermoset/thermoplastic mixture. Generally, the polymer is made conductive by the presence of silver, nickel, or carbon. Excellent results have been obtained when conductive layers 3' and 4' comprise polymer based thick film ink compositions. Preferably, conductive layers 3' and 4' can resist temperatures of up to 280° C. In a preferred embodiment, conductive layers 3' and 4' comprise a polymer based thick film ink such as CB115, manufactured by DuPont Electronic Materials.

In another embodiment of the present invention, conductive layers 3' and 4' comprise a metal particulate selected from the group consisting of silver, nickel, copper, platinum, and gold. Preferably, conductive layers 3' and 4' comprise silver flake or silver powder.

With reference to FIG. 3, it is preferred that portions of electrodes 5' and 6' are embedded in, or in direct physical contact with, PTC element 2'. However, the present invention also covers embodiments where electrodes 5' and 6' are embedded in conductive layers 3' and 4', and are not in direct physical contact with PTC element 2'.

Figure 4:
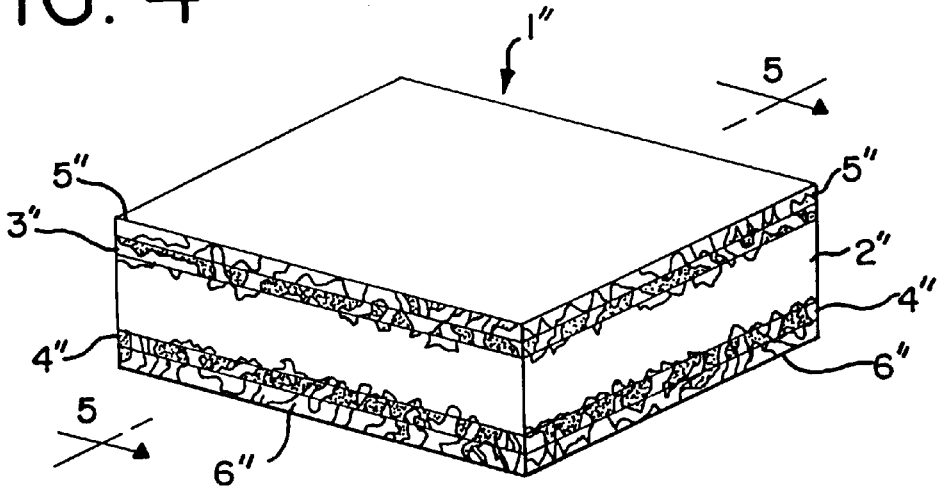
FIG. 4 is a perspective view of an electrical circuit protection device according to a second embodiment of the present invention.
Figure 5:
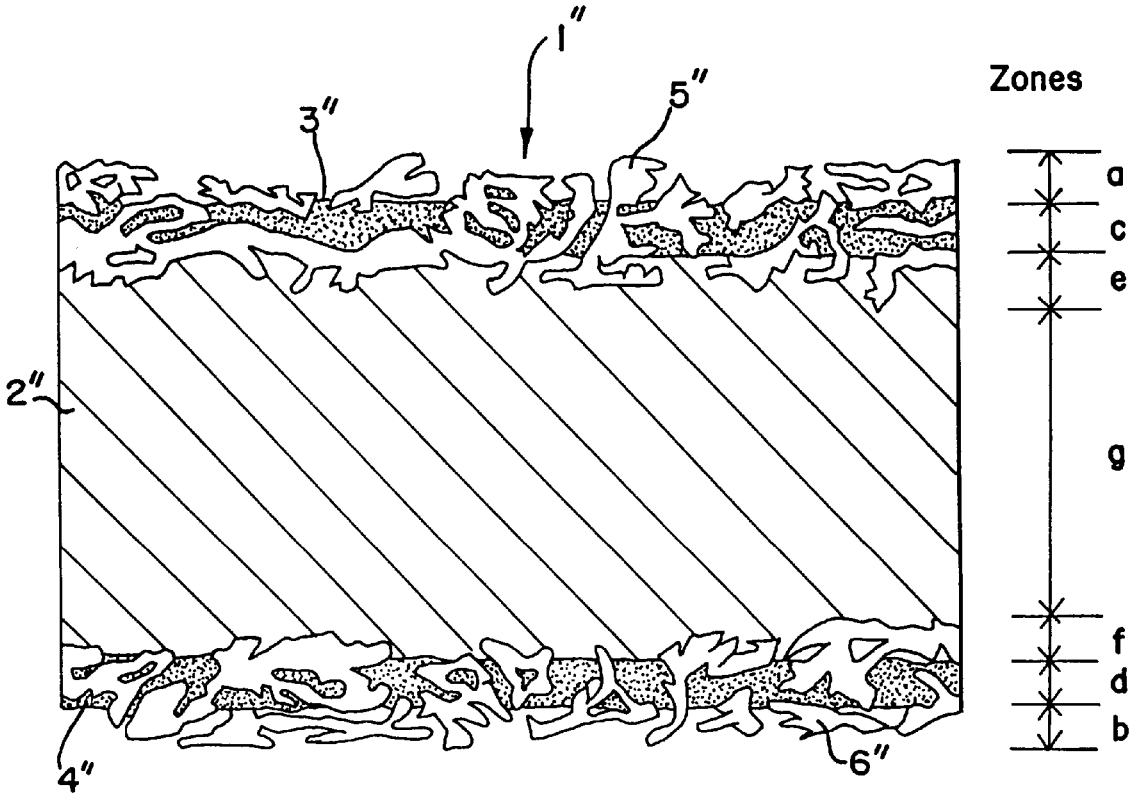
FIG. 5 is a cross-sectional view of the electrical circuit protection device in FIG. 4.

Referring now to FIGS. 4 and 5, electrodes 5" and 6" comprise a three-dimensional, initially open, irregular cellular structure characterized by an inner boundary and an outer boundary. The interface between PTC element 2" and electrodes 5" and 6", and the interface between conductive layers 3" and 4" and electrodes 5" and 6" lie within the inner and outer boundaries of electrodes 5" and 6", not at a surface thereof. Any surface contact is along a plurality of cell walls and intercies between cells in the electrode structure.

In a preferred embodiment, illustrated in FIG. 5, instead of a layered laminate electrical device, the electrical device is really comprised of seven separate zones. Two opposed outer zones comprise empty open electrode cells (zones a and b in FIG. 5). These electrode cells may optionally be filled by plating, soldering or the like. Inward of zones a and b are two opposed zones of electrode cells filled with conductive layers 3" and 4" (zones c and d in FIG. 5). Inward of zones c and d are two opposed zones of electrode cells filled with PTC element 2" (zones e and f in FIG. 5). A central inner zone (zone g in FIG. 5) is comprised solely of PTC element 2". The distance between the inner boundary and the outer boundary of each electrode is less than 0.01 inch, preferably between 0.003 to 0.008 inch. PTC element 2" and conductive layers 3" and 4" are identical to those embodiments described above and illustrated in FIGS. 2 and 3.

While the seven zone structure described above is preferred for an electrical device having cellular structured electrodes, in another embodiment of the present invention (not pictured) the electrical device comprises five zones. Two opposed outer zones have empty open electrode cells (which may optionally be filled with metal by plating, soldering or the like). Inward of the outer zones are two opposed zones of electrode cells filled with conductive layers. A central inner zone is comprised solely of the PTC element. In this five zone embodiment, the cellular structure of each electrode is not in direct physical contact with PTC element.

Figure 6:
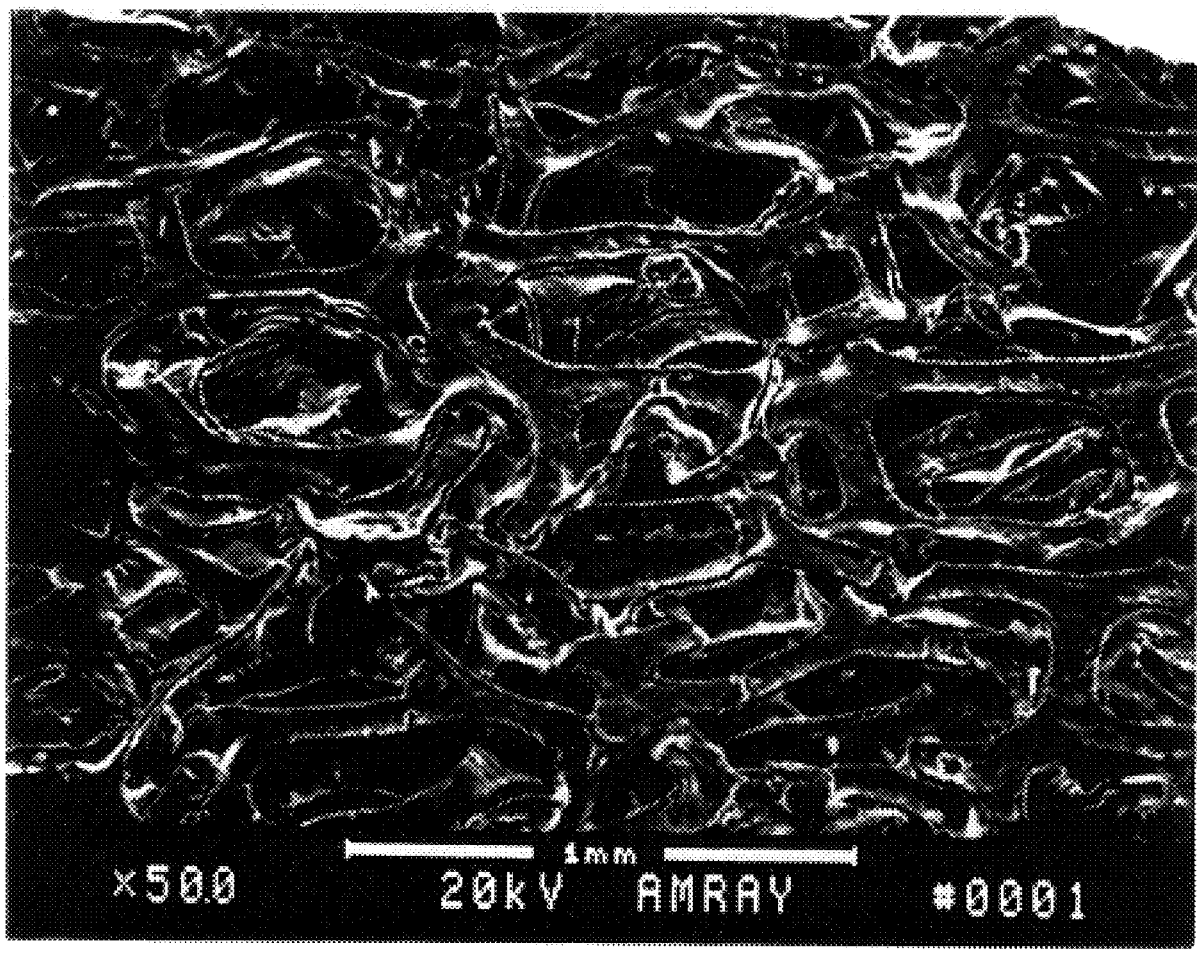
FIG. 6 is a microphotograph (enlarged 50 times) of the electrode material illustrated in the electrical circuit protection device in FIGS. 4 and 5.

Preferably, the three-dimensional, initially open cellular structured electrodes comprise a metal selected from the group consisting of nickel, copper, zinc, silver, and gold. It is especially preferred that the three-dimensional, initially open cellular structured metal electrodes comprise metal foam, preferably nickel, such as the nickel foamed electrodes manufactured by Inco Specialty Powder Products. FIG. 6 is a microphotograph (enlarged 50 times) of the preferred three-dimensional, initially open cellular structured electrodes illustrated in FIG. 5.

The electrical devices of the present invention generally have an electrical resistance at 25° C. of less than 1 ohm, preferably have an electrical resistance at 25° C. of 0.1 ohm to 0.3 ohm, and more preferably have an electrical resistance at 25° C. of less than 0.1 ohm.

It has been found that PTC electrical devices of the present invention can be prepared by dispersing conductive particles into a polymer to form a polymer PTC composition. The PTC composition is then melt-shaped to form a laminar PTC element. First and second opposed surfaces of the PTC element are then coated with a conductive layer. First and second electrodes are brought into contact with the coated surfaces of the PTC element. The electrodes can include any of those described above (i.e., wire mesh, screen mesh, wire cloth, perforated sheet metal, expanded metal, or electrodes with a three-dimensional, initially-open, irregular cellular structure). The sandwich structure, i.e., the coated PTC element interposed between two electrodes, is then heated while applying pressure to form a laminate. The laminate is then further formed into a plurality of PTC electrical devices.

While the step of melt-shaping the PTC composition into a laminar shaped PTC element may be carried out by commonly known polymer shaping methods, extrusion or compression molding is preferred.

The step of heating and applying pressure to the sandwich structure is generally carried out at a pressure of at least 100 p.s.i. and a temperature of at least 180° C. for a period of at least 1 minute. Preferably, the step of heating and applying pressure to the coated PTC element and electrodes is carried out at a pressure of 350 to 450 p.s.i. and a temperature of 200 to 235° C. for approximately 3 to 5 minutes. Excellent results have been obtained, however, when the step of heating and applying pressure is carried out at approximately 220° C. and 300 p.s.i. for 1 minute, relieving the pressure, and then further subjecting the coated PTC element and electrodes to 625 p.s.i. at 235° C. for 5 minutes.

In a preferred embodiment, the PTC electrical circuit protection devices of the present invention include a conductive terminal electrically connected to the outer surface of each electrode. The conductive terminal is connected to a source of electrical power, causing current to flow through the device. The terminals are soldered to the electrodes by applying a conductive paste to the outer surface of each electrode. The terminals are brought into contact with the conductive paste and heated so that the conductive paste is in a molten state. The molten paste is then cooled until it solidifies, whereby the conductive terminals are attached to the electrodes of the device. A solder preform may be substituted for the conductive paste in the above described process.

In another embodiment, terminals are applied to the outer surface of each electrode. The terminals and the PTC device are dipped into a flux, (i.e., a solution used to remove oxides from, and prevent further oxidation of, fused metals). The PTC device and terminals are then dipped into a molten solder bath. The device is then allowed to cool, whereby the solder solidifies, attaching the terminals to the electrodes.

In the processes employing the conductive paste or the solder preform, the device will be exposed to temperatures of approximately 280° C. during the step of heating the conductive paste or solder preform to a molten state. In the process employing a molten solder bath, the device will be exposed to temperatures of approximately 265° C. Therefore, the composition of the conductive layer must be able to resist temperatures of up to 280° C. While the mechanism is not completely understood, it is believed that conductive particles are leached from the composition of the conductive layers when the conductive layers cannot resist temperatures up to 280° C. The result is a device with an initially high electrical resistance.

Thus, in a preferred embodiment the conductive layer comprises CB115, a polymer based thick film ink manufactured by DuPont Electronic Materials comprising the following composition: 10–15% (by weight) diethylene glycol monoethyl ether acetate, 1–5% terpineol, 1–5% n-butanol, and 65–75% silver. Since CB115 can resist soldering temperatures up to 280° C., the silver remains in the polymer based thick film ink composition. The result is a device with a low electrical resistance, i.e., a device that has an electrical resistance at 25° C. of less than 1 ohm, preferably has an electrical resistance at 25° C. of 0.1 ohm to 0.3 ohm, and more preferably has an electrical resistance at 25° C. of less than 0.1 ohm.

In order to indicate more fully the nature and utility of this invention, the following examples are set forth, it being understood that these examples are presented as illustrative only and are not intended to limit the scope of the invention.

EXAMPLE 1

A quantity of high density polyethylene (HDPE) (manufactured by Quantum under the trade name Petrothene) and carbon black (manufactured by Cabot under the trade name BP 160-Beads) was dried by placing it in an oven at 100° C. overnight. A PTC polymer composition was prepared using the polyethylene and carbon black in the amounts listed below in Table 1.

TABLE 1

| | density (gm/cc) | volume (%) | weight (%) | weight (gm) |
|---|---|---|---|---|
| HDPE (Petrothene LB8520-00) | 0.96 | 65 | 49.08 | 117.78 |
| Carbon Black (BP 160-Beads) | 1.85 | 35 | 50.92 | 122.22 |
| Total | 1.2715 | 100 | 100 | 240 |

The polyethylene was placed in a C. W. Brabender Plasti-Corder PL 2000 equipped with a Mixer-Measuring Head and fluxed at 200° C. for approximately 5 minutes at 5 rpm. At this point the polyethylene was in a molten form. The carbon black was then slowly dispersed into the molten polyethylene over a 5 minute period at 200° C. at 5 rpm. The speed of the Brabender mixer was then increased to 80 rpm, and the HDPE and carbon black were thoroughly mixed at 200° C. for 5 minutes. The energy input, due to the mixing, caused the temperature of the composition to increase to 240° C.

After allowing the composition to cool, the composition was then placed into a C. W. Brabender Granu-Grinder where it was ground into small chips. The chips were then fed into the C. W. Brabender Plasti-Corder PL 2000 equipped with an Extruder Measuring Head. The extruder was fitted with a die having an opening of 0.002 inch, and the belt speed of the extruder was set at 2. The temperature of the extruder was set at 200° C., and the screw speed of the extruder was measured at 50 rpm. The chips were extruded into a sheet approximately 2.0 inches wide by 8 feet long. This sheet was then cut into a number of 2 inch×2 inch sample PTC elements, and pre-pressed at 200° C. to a thickness of approximately 0.01 inch.

A polymer based thick film ink (CB115, manufactured by DuPont Electronic Materials) was then applied to the top and bottom surfaces of the 2 inch×2 inch polymer PTC sample elements.

The electrode material selected was copper wire cloth (No. 9224T39, distributed by McMaster-Carr). The wire cloth electrode material had 100×100 mesh per linear inch, a wire diameter of 0.0045 inch, and a width opening of 0.006 inch. The copper wire cloth was then plated with silver using conventional electrolysis methods. The silver-plated copper wire electrodes measured approximately 0.004 inch thick. The electrodes were then affixed to the top and bottom thick film ink coated surfaces of the polymer PTC sample elements and placed in a hot press for approximately four minutes at 400 p.s.i. and 230° C. The 2 inch×2 inch laminated sheet was then removed from the press and allowed to cool without further pressure. The laminated sheet was then sheared into a plurality of 0.150 inch×0.180 inch polymer PTC electrical circuit protection devices. The circuit protection devices had an average thickness of 0.0175 inch.

Conductive terminals or leads were attached to the devices in the following manner: (1) terminals were applied to the outer surface of each electrode; (2) the terminals and the PTC device were dipped into a flux (i.e., a solution used to remove oxides from, and prevent further oxidation of, fused metals); (3) the terminals and the PTC device were dipped into a molten solder bath; and, (4) the terminals and the PTC device were removed from the solder bath and allowed to cool, whereby the solder solidified, thus connecting the terminals to the electrodes of the device.

Comparison devices were prepared using the same materials and processes described above, except that the PTC element was not coated with a conductive layer. Instead, the silver-plated copper wire cloth electrodes were affixed directly to the PTC sample elements and then placed in a hot press for approximately four minutes at 400 p.s.i. and 230° C. The laminated sheet was then removed from the press and allowed to cool without further pressure. The laminated sheet was then sheared into a plurality of 0.150 inch×0.180 inch polymer PTC electrical circuit protection devices. The comparison devices had an average thickness of 0.0145 inch. Terminals were applied to the comparison devices in the same manner as they were applied to the devices of the present invention in Example 1.

The electrical and mechanical properties of the electrical circuit protection devices of the present invention (wire cloth electrodes with a conductive layer) and those of the comparison devices (wire cloth electrodes without a conductive layer) were then tested. These tests consisted of measuring the initial electrical resistance of the devices at 25° C. with an ESI milliohmeter equipped with Kelvin clip leads. The electrode adhesion of the devices was measured using a tensile tester with a digital readout (manufactured by Scott, Model CRE/500). The procedure included:

1) Positioning the leads so that they are axial to the body of the device;
2) Insert one lead in pneumatically controlled jaws;
3) Insert opposite lead in manual vise type jaw;
4) Set tensile tester at:
   a) Tension (Pull),
   b) 0.5 IN/MIN Pull Speed,
   c) 5% Load (25 lbs. maximum);
5) Set Recorder at:
   a) 5% Full Load (25 lbs. maximum),
   b) Pen write on,
   c) Servo on;
6) Push "UP" button and allow to run until separation is complete. Total Pull (lbs.) will register on the Recorder.

The results of these tests are listed in Table 2 below.

TABLE 2

| | MESH/THICK FILM INK CONDUCTIVE LAYER | | MESH | |
|---|---|---|---|---|
| SAMPLE NO. | INITIAL RESISTANCE (Ohms) | PULL TEST (lbs.) | INITIAL RESISTANCE (Ohms) | PULL TEST (lbs.) |
| 1 | 0.1870 | 1.40 | 0.3411 | 0.90 |
| 2 | 0.1809 | 2.70 | 0.3542 | 0.70 |
| 3 | 0.1924 | 1.40 | 0.3393 | 1.20 |
| 4 | 0.1991 | 2.30 | 0.2941 | 1.20 |
| 5 | 0.1938 | 1.20 | 0.3899 | 1.60 |
| 6 | 0.1847 | 1.75 | 0.3001 | 1.10 |
| 7 | 0.1927 | 2.00 | 0.2887 | 1.10 |
| 8 | 0.1829 | 1.60 | 0.3354 | 1.10 |
| 9 | 0.2014 | 1.75 | 0.3007 | 0.75 |
| 10 | 0.1840 | 2.30 | 0.2879 | 1.25 |
| AVERAGE | 0.1899 | 1.84 | 0.3231 | 1.09 |
| MINIMUM | 0.1809 | 1.20 | 0.2879 | 0.70 |
| MAXIMUM | 0.2014 | 2.70 | 0.3542 | 1.60 |

EXAMPLE 2

A number of 2 inch×2 inch sample PTC elements were prepared in the same manner as disclosed Example 1. A polymer based thick film ink (CB115, manufactured by DuPont Electronic Materials) was then applied to the top and bottom surfaces of the 2 inch×2 inch polymer PTC sample elements and cured for 20 minutes at 120° C.

The electrode material selected was a nickel foam supplied by Inco Specialty Powder Products. The nickel foam had an initial volume thickness between boundaries of approximately 0.080 inch. The density of the supplied nickel foam material was 600±50 g/m$^2$, with an average cell size in the range of 500 to 700 $\mu$m. The nickel foam material was rolled down to a volume thickness between boundaries of approximately 0.005 inch and cleaned in a solution comprised of 50% $HNO_3$ and 50% Acetic Acid.

The nickel foam electrodes were then affixed to the top and bottom thick film ink coated surfaces of the polymer PTC sample elements and placed in a hot press which had plates set at a temperature of 235° C. The temperature of the laminate was monitored until it reached 220° C., at which point a total pressure of 1200 pounds (300 p.s.i.) was applied to the laminate for 1 minute. The pressure in the press was then relieved. The laminate was then exposed to a total pressure of 2500 pounds (625 p.s.i.) for 5 minutes, while maintaining the plates of the press at 235° C. The 2 inch×2 inch laminate was then removed from the press and allowed to cool without further pressure. The laminate was then sheared into a plurality of 0.150 inch×0.180 inch polymer PTC electrical circuit protection devices. The circuit protection devices had an average thickness of 0.0193 inch.

Conductive terminals or leads were applied to the PTC devices of the present invention in the same manner as in Example 1.

Comparison devices were prepared using the same materials and processes described above, except that the PTC element was not coated with a conductive layer. Instead, the nickel foam electrodes were affixed directly to the PTC sample elements and placed in a hot press which had plates set at a temperature of 235° C. The temperature of the laminate was monitored until it reached 220° C., at which point a total pressure of 1200 pounds (300 p.s.i.) was applied to the laminate for 1 minute. The pressure in the press was then relieved. The laminate was then exposed to a total pressure of 2500 pounds (625 p.s.i.) for 5 minutes, while maintaining the plates of the press at 235° C. The laminate was then removed from the press and allowed to cool without further pressure. The laminate was then sheared into a plurality of 0.150 inch×0.180 inch polymer PTC electrical circuit protection devices. The circuit protection devices had an average thickness of 0.0185 inch. Conductive terminals or leads were applied to the comparison samples in the same manner as in Example 1.

The electrical properties of the electrical circuit protection devices of the present invention (nickel foam electrodes with a polymer based thick film ink conductive layer) and those of the comparison devices (nickel foam electrodes without a conductive layer) were then tested. The tests consisted of measuring the initial electrical resistance of the devices at 25° C. using an ESI milliohmeter equipped with Kelvin clip leads. The results of these tests are listed in Table 3 below.

TABLE 3

| | NI FOAM/THICK FILM INK CONDUCTIVE LAYER | NI FOAM |
|---|---|---|
| SAMPLE NO. | INITIAL RESISTANCE (Ohms) | INITIAL RESISTANCE (Ohms) |
| 1 | 0.1686 | 0.3579 |
| 2 | 0.1674 | 0.3509 |
| 3 | 0.1621 | 0.3859 |
| 4 | 0.1582 | 0.4213 |
| 5 | 0.1770 | 0.4184 |
| 6 | 0.1619 | 0.4008 |
| 7 | 0.1647 | 0.3717 |
| 8 | 0.1882 | 0.3557 |
| 9 | 0.1546 | 0.3867 |
| 10 | 0.1492 | 0.3852 |
| AVERAGE | 0.1652 | 0.3835 |
| MINIMUM | 0.1492 | 0.3509 |
| MAXIMUM | 0.1882 | 0.4213 |

A number of 2 inch×2 inch sample PTC elements were prepared in the same manner as disclosed in Example 1. A 2 inch×2 inch sample PTC element was dipped in silver flake (Type SF 40 manufactured by Degussa).

The electrode material selected was a nickel foam supplied by Inco Specialty Powder Products. The nickel foam had an initial volume thickness between boundaries of approximately 0.080 inch. The density of the supplied nickel foam material was 600±50 g/m$^2$, with an average cell size in the range of 500 to 700 $\mu$m. The nickel foam material was rolled down to a volume thickness between boundaries of approximately 0.005 inch and cleaned in a solution comprising 50% $HNO_3$ and 50% Acetic Acid.

The nickel foam electrodes were then affixed to the top and bottom silver-flake coated surfaces of the polymer PTC sample elements and placed in a hot press which had plates set at a temperature of 235° C. The temperature of the laminate was monitored until it reached 220° C., at which point a total pressure of 1200 pounds (300 p.s.i.) was applied to the laminate for 1 minute. The pressure in the press was then relieved. The laminate was then exposed to a total pressure of 2500 pounds (625 p.s.i.) for 5 minutes, while maintaining the plates of the press at 235° C. The 2 inch×2 inch laminate was then removed from the press and allowed to cool without further pressure. The laminate was then sheared into a plurality of 0.150 inch×0.180 inch polymer PTC electrical circuit protection devices. The circuit protection devices had an average thickness of 0.0180 inch. Conductive terminals or leads were electrically connected to the devices in the same manner as in Examples 1 and 2.

The test results of the comparison devices prepared in Example 2 were used to illustrate the improved electrical properties of the circuit protection devices of the present invention prepared in Example 3.

The electrical properties of the electrical circuit protection devices of the present invention (nickel foam electrodes with a silver-flake conductive layer) and those of the comparison devices (nickel foam electrodes without a conductive layer) were then tested. The tests consisted of measuring the initial electrical resistance of the devices at 25° C. using an ESI milliohmeter equipped with Kelvin clip leads. The results of these tests are listed in Table 4 below.

TABLE 4

| NI FOAM/SILVER FLAKE CONDUCTIVE LAYER | | NI FOAM |
|---|---|---|
| SAMPLE NO. | INITIAL RESISTANCE (Ohms) | INITIAL RESISTANCE (Ohms) |
| 1 | 0.2886 | 0.3579 |
| 2 | 0.2520 | 0.3509 |
| 3 | 0.2466 | 0.3859 |
| 4 | 0.2783 | 0.4213 |
| 5 | 0.2631 | 0.4184 |
| 6 | 0.3141 | 0.4008 |
| 7 | 0.2497 | 0.3717 |
| 8 | 0.2639 | 0.3557 |
| 9 | 0.2959 | 0.3867 |
| 10 | 0.2772 | 0.3852 |
| AVERAGE | 0.2729 | 0.3835 |
| MINIMUM | 0.2466 | 0.3509 |
| MAXIMUM | 0.3141 | 0.4213 |

The test results in Tables 2–4 illustrate that a lower resistant PTC device can be achieved when practicing the present invention. In addition, the results in Table 2 illustrate an improved mechanical adhesion between the electrode and the PTC element when practicing the present invention.

While the specific embodiments have been illustrated and described, numerous modifications come to mind without markedly departing from the spirit of the invention. The scope of protection is only intended to be limited by the scope of the accompanying claims.

I claim:

1. An electrical device comprising:

a PTC element including a polymer with electrically conductive particles dispersed therein, said PTC element having first and second surfaces;

a pair of conductive layers respectively contacting said first and second surfaces of said PTC element;

a pair of electrodes, each said electrode being comprised of a metal foam material having an inner surface extending through one of said conductive layers so that said inner surface is in direct physical contact with said PTC element, and an outer surface; and, a portion of said outer surface of each said electrode projecting outwardly from each conductive layer, respectively, so as to be connectable to a source of electrical power, and when so connected, causing current to flow through said PTC element.

2. An electrical device according to claim 1, wherein said polymer comprises a polyolefin.

3. An electrical device according to claim 1, wherein said electrically conductive particles comprise a conductive material selected from the group consisting of pure metal particles, metal alloy particles, and carbonaceous particles.

4. An electrical device according to claim 1, wherein said electrodes comprise a metal selected from the group consisting of nickel, copper, zinc, silver, and gold.

5. An electrical device according to claim 1 wherein said PTC element includes a non-conductive particulate filler.

6. An electrical device according to claim 2, wherein said polyolefin comprises polyethylene.

7. An electrical device according to claim 3, wherein said conductive particles comprise carbon black.

8. An electrical device according to claim 5, wherein said non-conductive filler comprises fumed silica.

9. An electrical device according to claim 1, wherein the distance between said inner surface and said outer surface of each said electrode is less than 0.010 inch.

10. An electrical device according to claim 9, wherein said distance between said inner surface and said outer surface of each said electrode is 0.003 to 0.008 inch.

11. An electrical device according to claim 1, wherein said PTC element is less than 0.03 inch thick.

12. An electrical device according to claim 1, wherein said PTC element is less than 0.02 inch thick.

13. An electrical device according to claim 1, wherein said PTC element has a resistivity at 25° C. of less than 5 ohm cm.

14. An electrical device according to claim 1, wherein said PTC element has a resistivity at 25° C. of less than 1 ohm cm.

15. An electrical device according to claim 1, wherein said PTC element has a resistivity at 25° C. of less than 0.8 ohm cm.

16. An electrical device according to claim 1, wherein said device has a resistance at 25° C. of less than 1 ohm.

17. An electrical device according to claim 1, wherein said device has a resistance at 25° C. of 0.1 ohm to 0.3 ohm.

18. An electrical device according to claim 1, wherein said device has a resistance at 25° C. of legs than 0.1 ohm.

19. An electrical device according to claim 1, wherein said pair of conductive layers comprises a conductive polymer.

20. An electrical device according to claim 19, wherein said conductive polymer comprises silver.

21. An electrical device according to claim 1, wherein said pair of conductive layers comprises metal particles selected from the group consisting of silver, nickel, copper, platinum and gold.

22. An electrical device comprising:

a PTC element including a polymer with electrically conductive particles dispersed therein, said PTC element having first and second surfaces and a resistivity at 25° C. of less than 5 ohm cm;

a pair of conductive thick film ink layers respectively contacting said first and second surfaces of said PTC element;

a pair of electrodes, each said electrode being comprised of a metal foam material having an inner surface in direct physical contact with said PTC element and an outer surface;

a portion of said outer surface of each said electrode projecting outwardly from each conductive layer, respectively, so as to be connectable to a source of electrical power, and when so connected, causing current to flow through said PTC element; and, said electrical device having an initial resistance at 25° C. of less than 1.0 ohm.

23. An electrical device comprising:

a PTC element including a polymer with electrically conductive particles dispersed therein, said PTC element having first and second surfaces and a resistivity at 25° C. of less than 5 ohm cm;

a pair of conductive layers respectively contacting said first and second surfaces of said PTC element;

a pair of electrodes respectively confronting said conductive layers, each said electrode being comprised of a metal foam having an inner surface extending into said PTC element through the adjacent conductive layer and an outer surface, said inner and outer surfaces being separated by a mid-zone, at least a portion of each mid-zone being filled by said conductive layers, respectively; and, a portion of said outer surface of each electrode projecting outwardly from each conductive layer, respectively, so as to be exposed from said conductive layer and connectable to a source of electrical power, and when so connected, causing current to flow through said PTC element; and, said electrical device having an initial resistance at 25° C. of less than 1.0 ohm.

24. The device of claim 1 wherein a conductive terminal is secured to the portion of each said electrode projecting outwardly from each conductive layer, respectively.

* * * * *